US009439510B2

(12) United States Patent
Karins Sr.

(10) Patent No.: US 9,439,510 B2
(45) Date of Patent: Sep. 13, 2016

(54) RETROFIT SHOWER CORNER SHELF ASSEMBLY

(71) Applicant: William Joseph Karins Sr., Sarasota, FL (US)

(72) Inventor: William Joseph Karins Sr., Sarasota, FL (US)

( * ) Notice: Subject to any disclaimer, the term of this patent is extended or adjusted under 35 U.S.C. 154(b) by 0 days.

(21) Appl. No.: 14/830,053

(22) Filed: Aug. 19, 2015

(65) Prior Publication Data

US 2016/0192777 A1 Jul. 7, 2016

Related U.S. Application Data

(60) Provisional application No. 62/099,781, filed on Jan. 5, 2015.

(51) Int. Cl.

| | |
|---|---|
| ***A47F 5/08*** | (2006.01) |
| ***A47B 96/02*** | (2006.01) |
| ***A47B 96/06*** | (2006.01) |
| ***A47K 3/28*** | (2006.01) |
| *D06F 57/12* | (2006.01) |

(52) U.S. Cl.

CPC ..... *A47B 96/022* (2013.01); *A47B 96/021* (2013.01); *A47B 96/024* (2013.01); *A47B 96/06* (2013.01); *A47K 3/281* (2013.01); *A47B 96/027* (2013.01); *D06F 57/12* (2013.01)

(58) Field of Classification Search

CPC .. A47B 96/022; A47B 96/06; A47B 96/024; A47B 96/021; A47B 96/027; A47K 3/281; D06F 57/12

USPC ..... 211/90.01, 90.02, 119.009, 87.01, 211/90.04, 134; 248/235, 239, 250, 309.1, 248/220.1; 108/42

See application file for complete search history.

(56) References Cited

U.S. PATENT DOCUMENTS 975,619 A * 11/1910 Hollander ..... A47B 96/02 108/42
1,159,813 A * 11/1915 Volkhardt ..... A47G 25/0685 211/104
1,286,588 A * 12/1918 Goodykoontz ..... F16M 13/02 108/28
1,500,487 A * 7/1924 Carlin ..... A47B 96/022 108/28
1,599,654 A * 9/1926 Cranston ..... A47B 96/022 211/153
1,654,409 A * 12/1927 Browne ..... A47B 81/002 108/29
2,096,024 A * 10/1937 Anderson ..... A47B 96/022 108/30

(Continued)

FOREIGN PATENT DOCUMENTS

GB 2109672 A * 6/1983 ..... A47B 96/022

*Primary Examiner* — Joshua J Michener
*Assistant Examiner* — Devin Barnett
(74) *Attorney, Agent, or Firm* — Shumaker Loop & Kendrick, LLP

(57) ABSTRACT

Disclosed is a retrofit shower corner shelf assembly kit including a shelf adapted for retrofitting into an existing shower corner; an adhesive composition for securing the shelf into the existing shower corner; and optionally a decorative composition for concealing edges of the shelf directly adjacent to the existing shower corner. Disclosed is a shelf adapted for retrofitting into an existing shower corner, the shelf includes two flat edges configured for securing the shelf directly on top of a surface and a third flat, free edge, wherein the shelf includes an upper layer, a middle layer attached to the upper layer, a lower layer attached to the middle layer, and the third flat, free edges conceals middle and lower layers of the shelf.

15 Claims, 16 Drawing Sheets

(56) References Cited

U.S. PATENT DOCUMENTS 2,254,847 A * 9/1941 Holt ..... H05K 7/04 248/220.1
2,465,635 A * 3/1949 Conterio ..... A47B 96/022 108/42
2,700,475 A * 1/1955 Stalter ..... A47B 96/022 108/42
3,033,376 A * 5/1962 Eastman ..... A47B 96/022 108/42
4,708,310 A * 11/1987 Smith ..... A47B 96/022 211/90.01
4,886,236 A * 12/1989 Randall ..... A47B 96/022 108/152
D313,720 S * 1/1991 Sorenson ..... D6/562
5,349,134 A * 9/1994 Russell ..... F21S 8/033 174/492
5,513,575 A * 5/1996 Slade ..... A47B 96/02 108/42
5,542,218 A * 8/1996 Rompel ..... A47K 3/40 4/611
5,588,370 A * 12/1996 Longley ..... A47B 96/022 108/42
5,732,421 A * 3/1998 Scherberger ..... A47K 3/282 248/220.1
D409,868 S * 5/1999 France ..... D6/562
6,059,128 A * 5/2000 Wang ..... A47B 96/02 108/42
6,079,336 A * 6/2000 Lindstrom ..... A47G 7/041 108/42
6,164,610 A * 12/2000 Santiago ..... A47B 96/066 211/90.01
6,591,762 B1 * 7/2003 Haghayegh ..... A47B 96/022 108/42
7,255,236 B1 * 8/2007 Sauder ..... A47B 96/022 211/135
7,419,126 B2 * 9/2008 Gibson ..... F16M 13/025 248/220.1
7,673,420 B2 * 3/2010 Madesh ..... A47C 11/00 4/611
7,883,066 B2 * 2/2011 Wiese ..... A47B 49/00 248/220.1
8,161,700 B2 * 4/2012 Scalise ..... E04F 13/08 4/571.1
8,225,435 B2 * 7/2012 Kik, Jr. ..... A47K 3/282 248/220.1
8,998,008 B1 * 4/2015 Robertson ..... A47B 96/022 108/42
9,277,818 B1 * 3/2016 Preston ..... A47B 96/022
2006/0156637 A1 * 7/2006 Blankenship ..... A47K 3/281 52/34
2008/0224004 A1 * 9/2008 Gallien ..... A47B 96/066 248/220.1
2009/0025139 A1 * 1/2009 Houpt ..... E04F 13/0862 4/578.1
2011/0168859 A1 * 7/2011 Baruch ..... A47B 96/022 248/241
2013/0264447 A1 * 10/2013 Baruch ..... A47B 96/06 248/235
2014/0197119 A1 * 7/2014 Stenhouse ..... A47B 96/022 211/26
2016/0095437 A1 * 4/2016 Crandall ..... A47B 96/022 211/90.01

* cited by examiner

RETROFIT SHOWER CORNER SHELF ASSEMBLY

CROSS REFERENCE TO RELATED APPLICATION

This U.S. Non-Provisional Patent Application claims priority from U.S. Provisional Patent Application No. 62/099,781 filed Jan. 5, 2015, which is incorporated herein in its entirety.

TECHNICAL FIELD

The present invention relates generally to the field of shelf assemblies, and more particularly, to retrofit shower corner shelf assemblies.

BACKGROUND

Over the past two decades, residential bathrooms have become increasingly more elaborate, lavish, and luxurious. In most high-end bathrooms, custom fixtures, custom made sinks, custom showers, custom baths, and custom wall and shower tile have become commonplace in residential homes and luxury hotels. For example, in most of these high-end custom bathrooms, showers utilize custom tile, including but not limited to, marble, granite, ceramic, and travertine. In these custom showers, corner shelves have also become increasingly popular to place shampoos, soap, and other toiletries inside the shower in lieu of alternative options such as shower caddies. These corner shelves advantageously provide the functional utility of storing items within the shower while concurrently being aesthetically pleasing.

Conventionally, these corner shelves have at least two different modes of installation. A first mode of installation includes framing a corner shelf area using lumber, which is subsequently covered with sheet rock. After hanging sheet rock within the shower area, and over the corner shelf area, decorative tile or stone is subsequently placed within the shower and forms both the shower area and the corner shelf. However, this method of forming a corner shelf within a shower is complex and time consuming. Also, these types of shower corner shelves are often susceptible to water damage and deterioration because water often penetrates through holes in the grout if the grouting is not constantly maintained. A second mode of installation includes, as illustrated for example in FIG. 1(*a*)-1(*c*), installing a pre-formed corner shelf 20 within an existing shower corner. As shown in FIG. 1(*a*), in order to install pre-formed shower corner shelf 20 within a pre-existing shower corner, a tile saw must first be used to cut and remove a portion of the tile that forms a groove/channel 10 capable of receiving complimentary protruding features 21, 22 from the pre-formed corner shelf 20. For example, when installing shelf 20, an adhesive is applied to protruding features 21, 22 and then protruding features 21, 22 are pressed into groove/channel 10 with sufficient pressure for a sufficient time period of time such that shelf 20 is fixed to the shower corner. After installation of the shelf 20, grout may be applied around lip 24 to prevent water from leaking into the wall immediately behind shelf 23 and the shower tile. After installing shelf 20, shelf ledge 23 can be used for toiletry storage. Similar to the first corner shelf installation mentioned above, the shower corner shelf installation depicted in FIGS. 1(*a*)-1(*c*) is also very time consuming and very complex. In addition, conventional shower corner shelves 20 are typically very heavy, which over time leads to structural fatigue resulting in cracks and/or gaps forming between lip 24 and the shower wall. Once cracks or gaps form, water leaks into groove/channel 10 and may lead to water damage to portions of the bathroom immediately behind shelf 20 and the shower tile.

BRIEF SUMMARY

Therefore, a need exists to provide a simplified and economical shower corner shelf that may be installed in a more time efficient, less intrusive manner while concurrently avoiding the disadvantages (e.g., water leakage) associated with conventional products discussed immediately above. Disclosed is a retrofit shower corner shelf and retrofit shower corner shelf assembly kit that may be installed in a short period of time with relatively little or no clean up. The disclosed retrofit shower corner shelf assembly kit includes a shelf adapted for retrofitting into an existing shower corner. The kit also includes an adhesive composition for securing the shelf into the existing shower corner; and optionally includes a decorative composition (e.g., grout or mortar) for concealing edges of the shelf directly adjacent to the existing shower corner.

In certain aspects, the shelf includes flat edges in which at least two flat edges are configured to contact and be secured directly on top of the existing shower corner.

In certain aspects, the shelf comprises an upper layer, a middle layer, and a lower layer.

In certain aspects, the upper layer of the shelf includes decorative stone, tile, or combinations thereof In certain aspects, the middle layer includes a lightweight material.

In certain aspects, the lightweight material includes cork, wood, cardboard, plastic, or combinations thereof.

In certain aspects, the shelf further includes a front edge having decorative material that conceals the middle and lower layers of the shelf, and the front edge may include the same decorative material as the upper layer.

In certain aspects, the kit includes two or more shelves.

Also, disclosed is a shelf adapted for retrofitting into an existing shower corner, the shelf may include two flat edges configured for securing the shelf directly on top of a surface and a third flat, free edge, wherein the shelf includes an upper layer, a middle layer attached to the upper layer, a lower layer attached to the middle layer, and the third flat, free edges conceals middle and lower layers of the shelf.

The shelf may include one or more grooves (e.g., arcuate grooves) on the bottom of the shelf configured to receive fasteners (e.g., screws, nails, or a combination thereof) fixed to a wall, thereby allowing for positioning and/or fixing the shelf into a shower corner. In certain aspects, the kit further includes a decorative plug adapted for placement in the grooves such that the groove and fastener may be concealed when the shelf is viewed from the bottom. In an alternative aspect, the kit may include a mounting bracket assembly adapted for placing the shelf thereon. This mounting bracket assembly may include two elongate L-shaped brackets each having spaced apart through holes with fasteners extending there through and being adapted for wall mounting (e.g., mounting to the shower corner). The mounting bracket assembly may further include a cross-brace positioned on a top surface of each L-shaped bracket thereby connecting two L-shaped brackets. In certain aspects, this cross-brace may be fixed to or removably attached to each L-shaped bracket. The cross-brace of the bracket assembly has sufficient thickness to provide a slightly declined slope to the shelf, when the shelf is positioned on the mounting bracket assembly. This slightly declined slope advantageously ensures that water properly flows away from the shower corner, thereby preventing premature deterioration of the two edges immediately adjacent the shower wall and the grout or mortar concealing these edges. The mounting bracket assembly may be made from metal (e.g., aluminum, stainless steel, or a combination thereof), a molded thermoplastic resin, or a combination thereof, and the mounting bracket assembly may include and exterior finish matching the shelf.

Also disclosed is a method of installing the shelves disclosed herein by applying an adhesive composition to the two flat edges; and pressing the two flat edges against a shower corner such that the adhesive composition permanently fixes the two flat edges on top of a surface of the shower corner.

Embodiments of the invention can include one or more or any combination of the above features and configurations.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

FIGS. 2-7 depict various views of the shower corner shelf 100 and the kit disclosed herein. In certain aspects, the shower corner shelf 100 includes two flat edges 111, 112 configured for securing the shelf directly on top of an existing shower surface, which preferably includes a shower corner. The shower corner shelf 100 also includes a third flat, free edge 113 that preferably remains free and does not contact the shower wall once the shelf 100 is installed in a shower corner.

Figure 1:
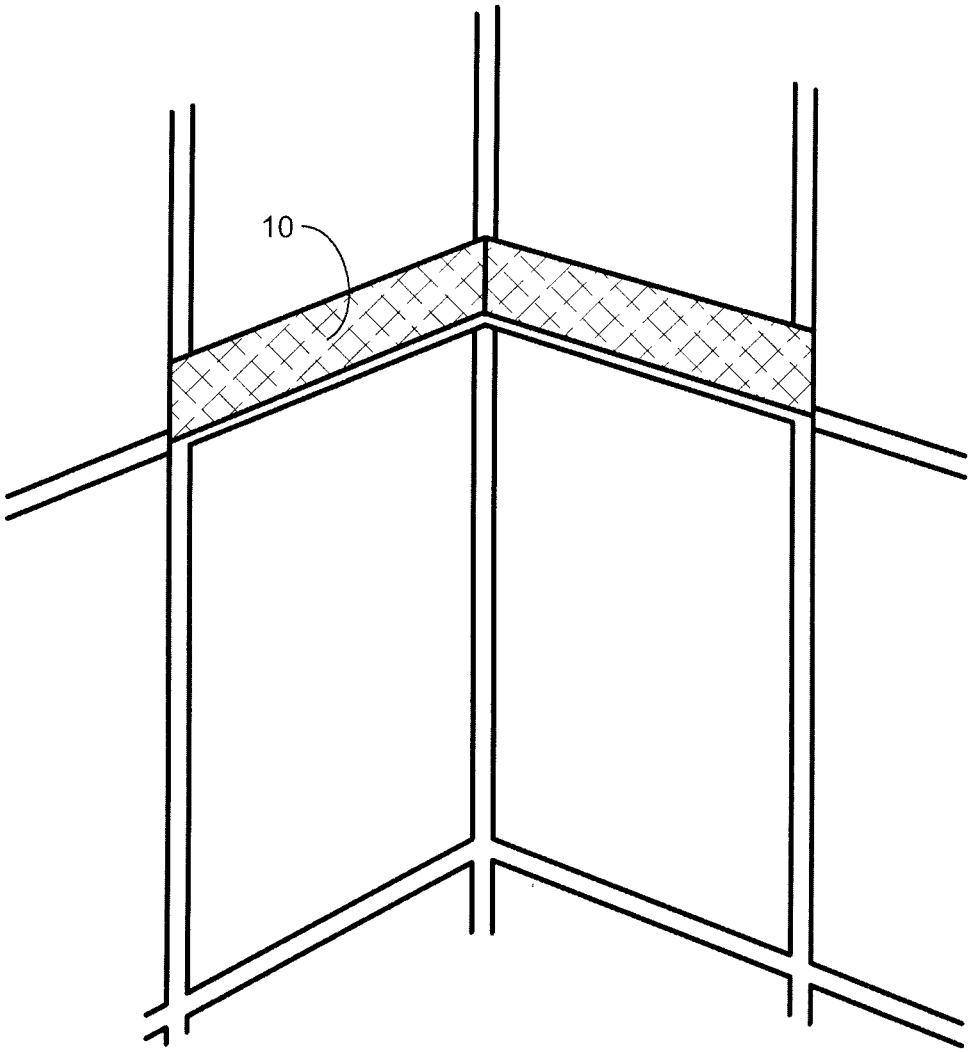
FIG. 1 (a) Prior Art
FIGS. 1(*a*)-1(*c*) depict the sequential installation of a conventional shower corner shelf.
Figure 1:
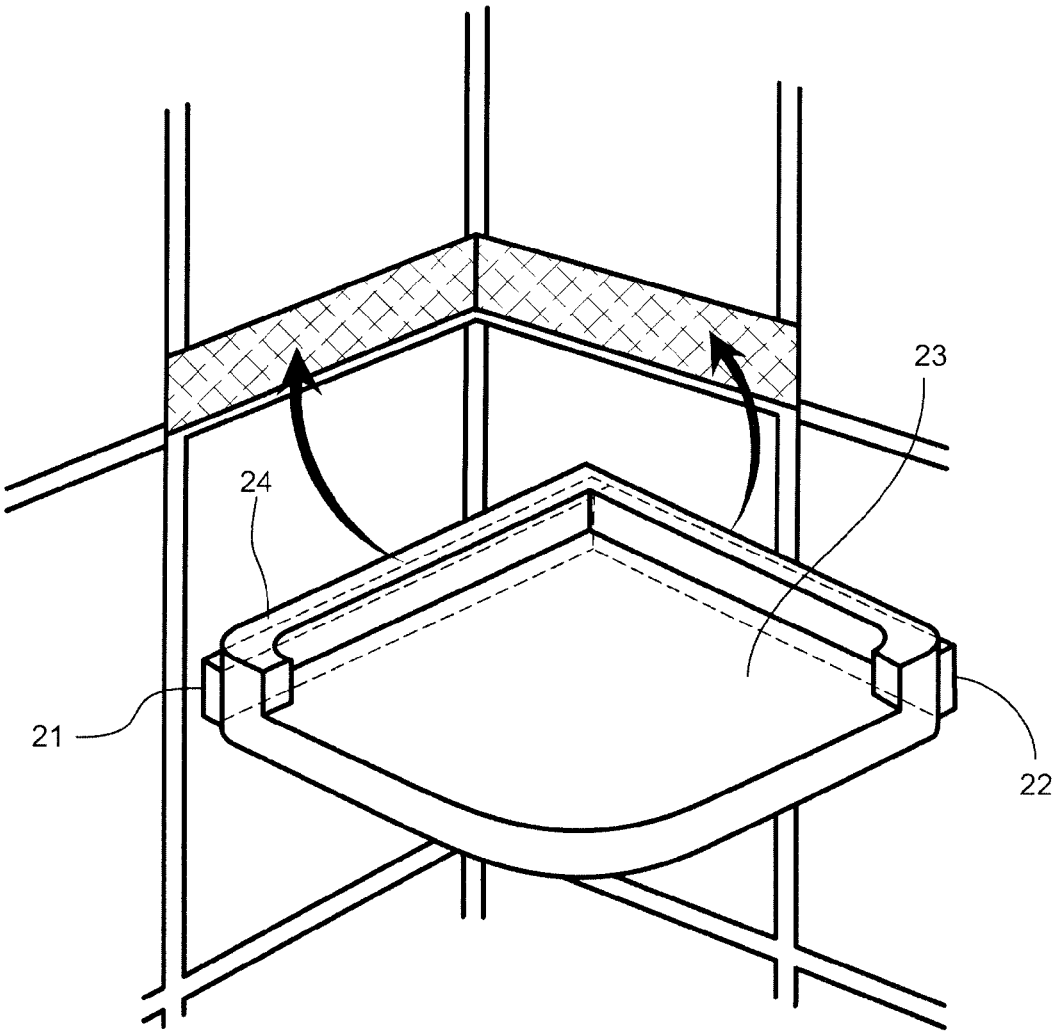
FIG. 1 (b) Prior Art
Figure 1:
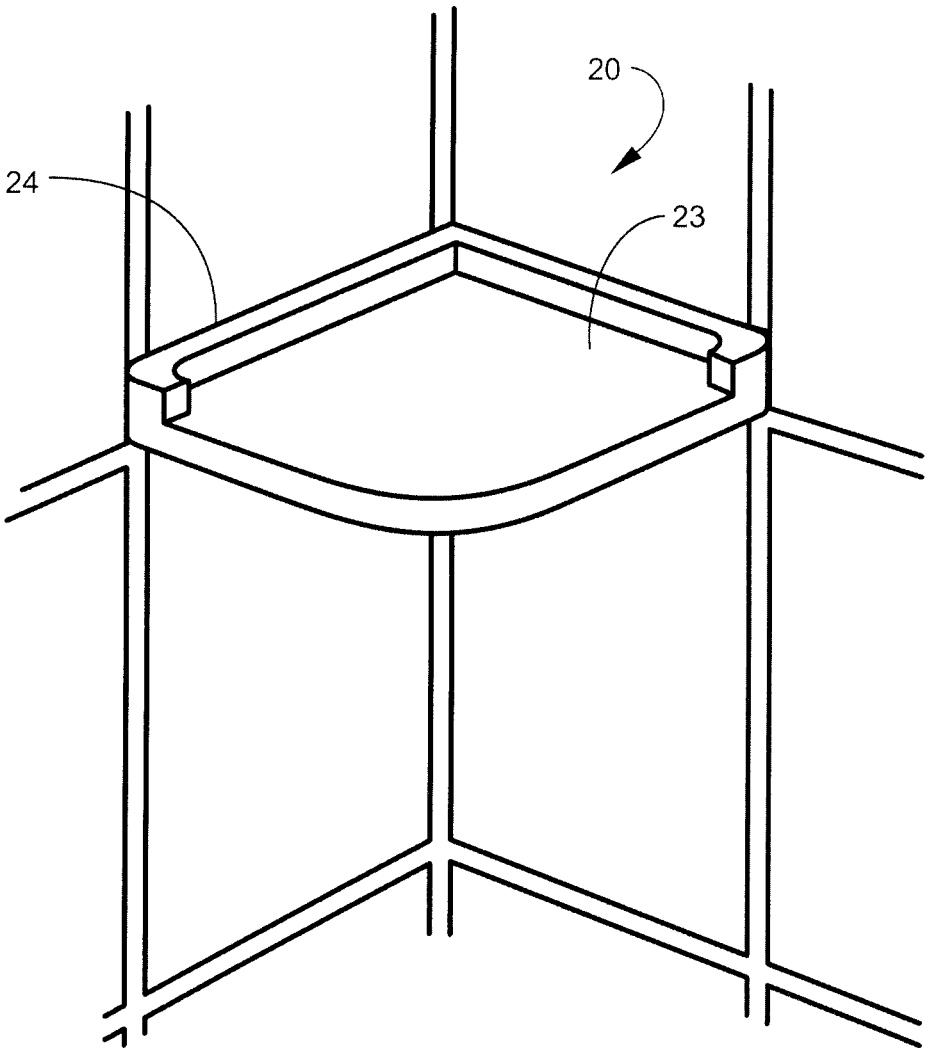
FIG. 1 (c) Prior Art
Figure 2:
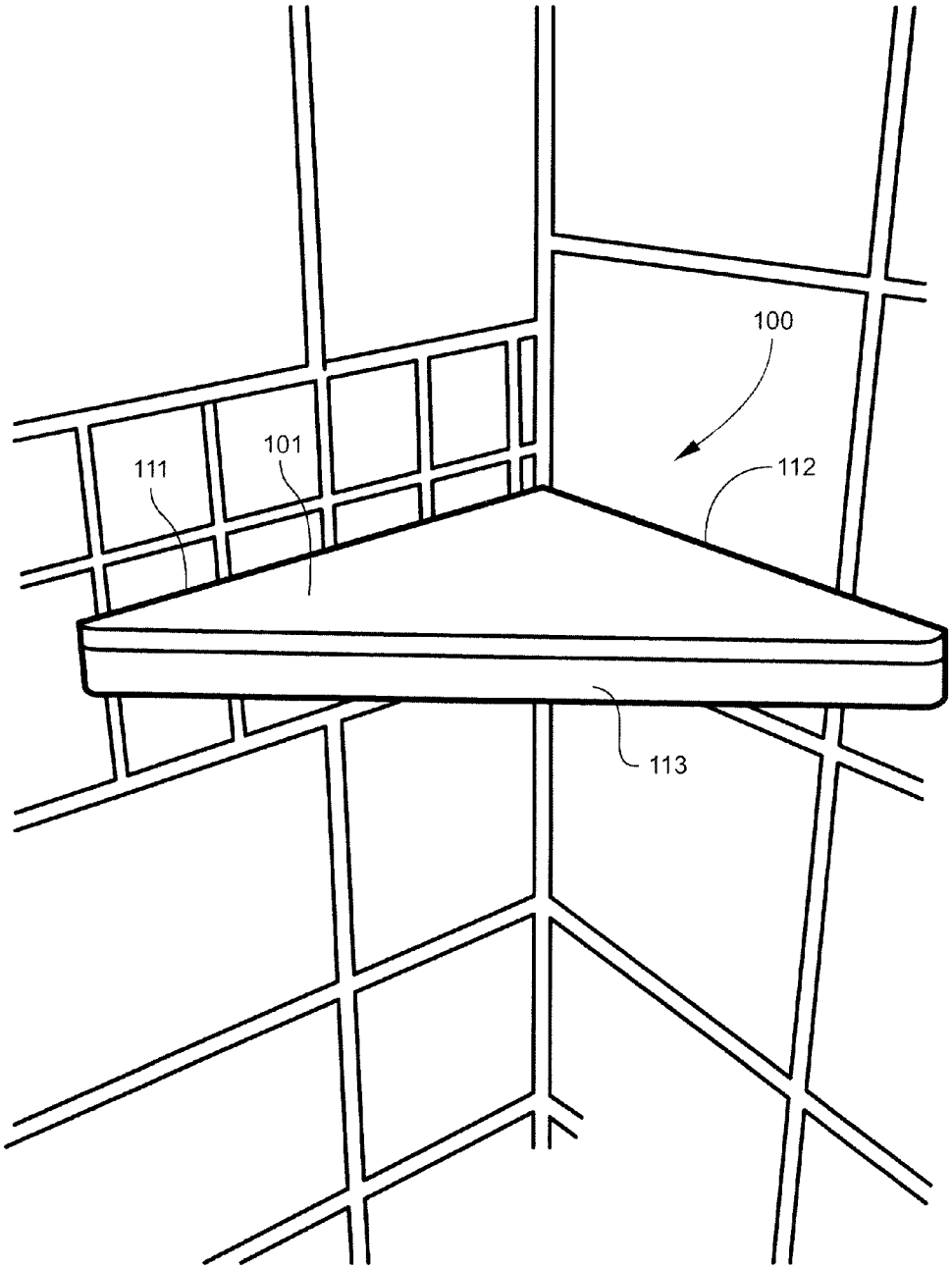
FIG. 2(*a*) depicts an exemplary shower corner shelf that includes travertine and grout, and FIG. 2(*b*) depicts the bottom side of the shelf having grooves for receiving fasteners and decorative plugs to conceal the grooves and fasteners post-installation.
Figure 2:
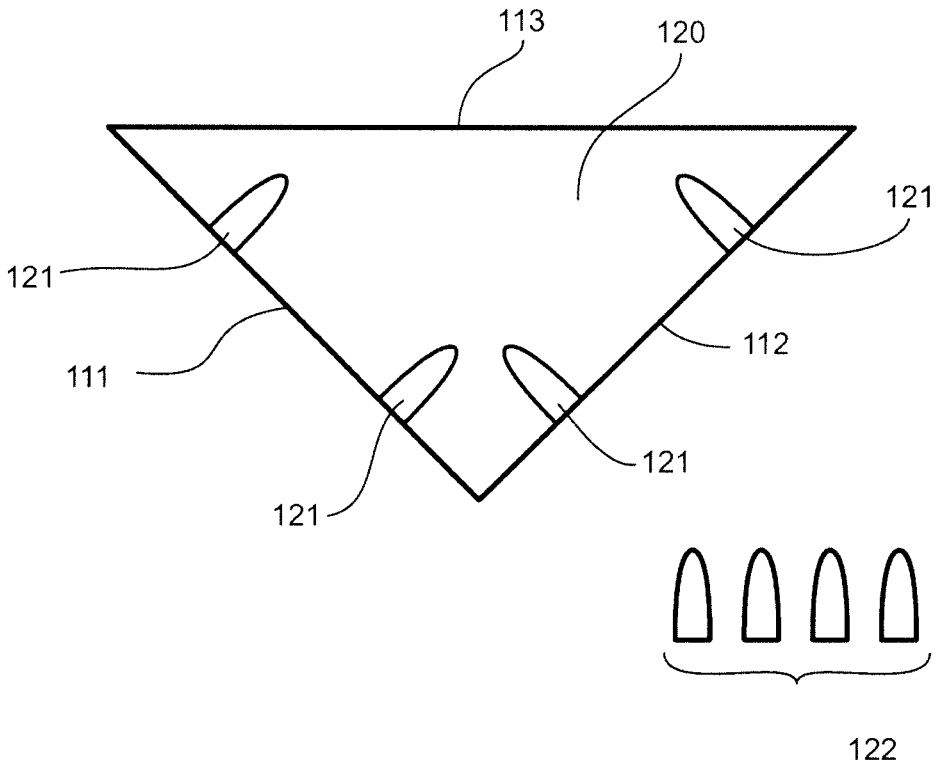
Figure 3:
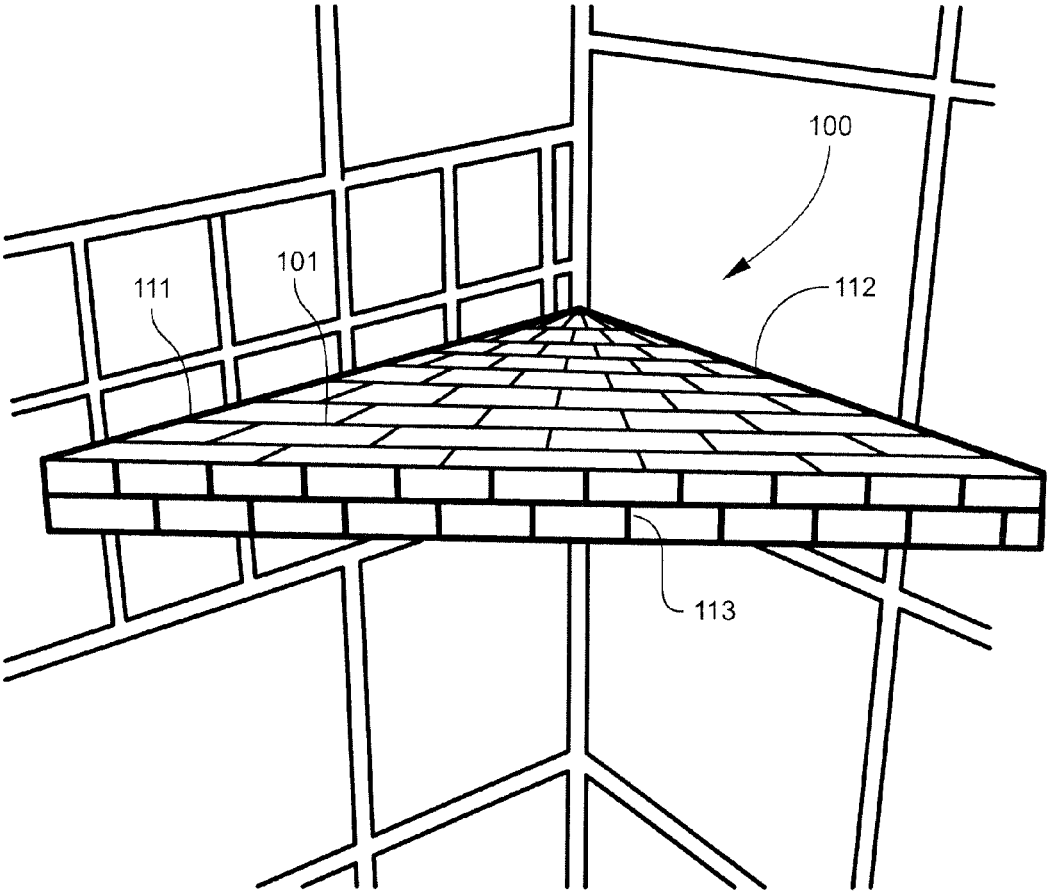
FIG. 3 depicts an exemplary shower corner shelf includes ceramic tile and grout.
Figure 4:
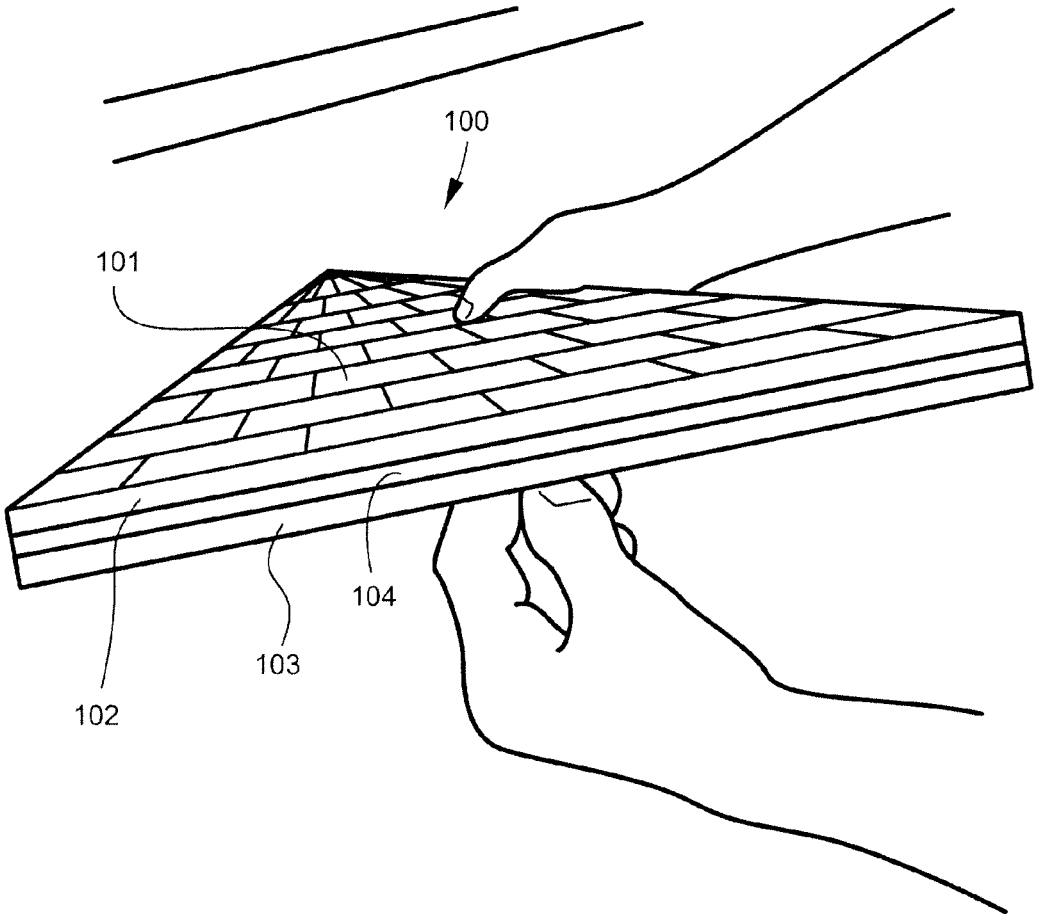
FIG. 4 depicts a cross-section of the shower corner shelf.
Figure 5:
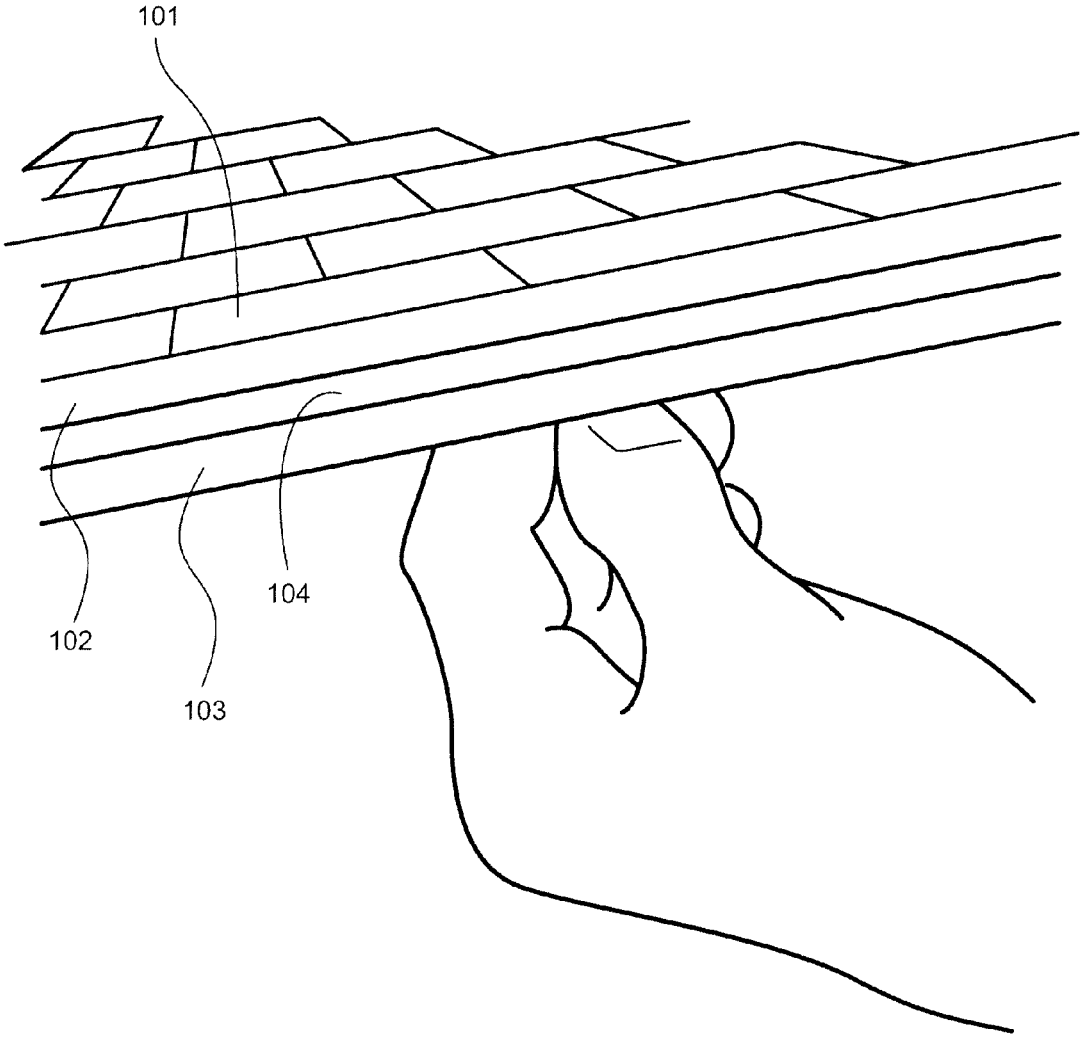
FIG. 5 depicts a magnified view of cross-section shown in FIG. 4 including the layers within the shower corner shelf.
Figure 6:
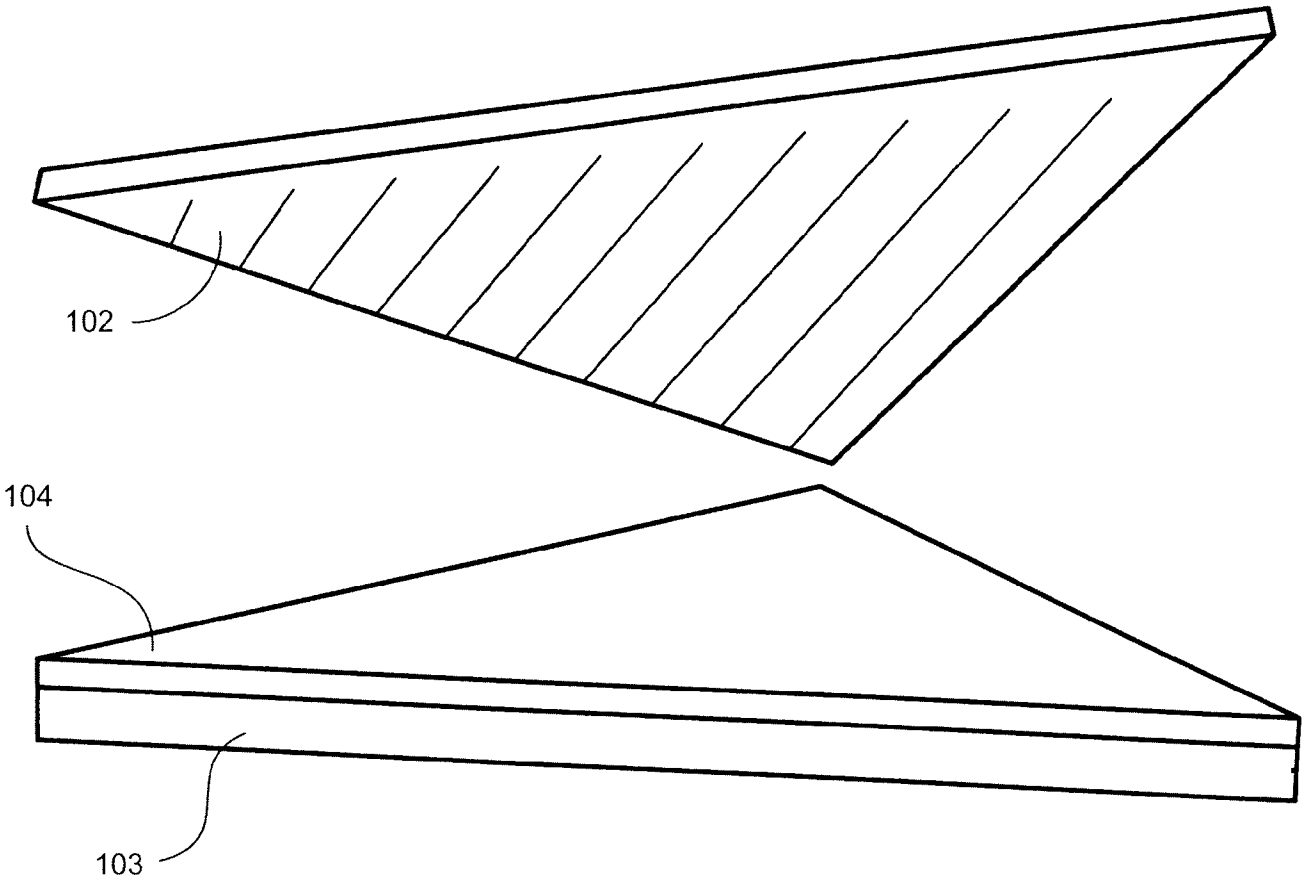
FIGS. 6(*a*) and 6(*b*) depicts various layers of the shower corner shelf during the assembly/production of the shower corner shelf.
Figure 6:
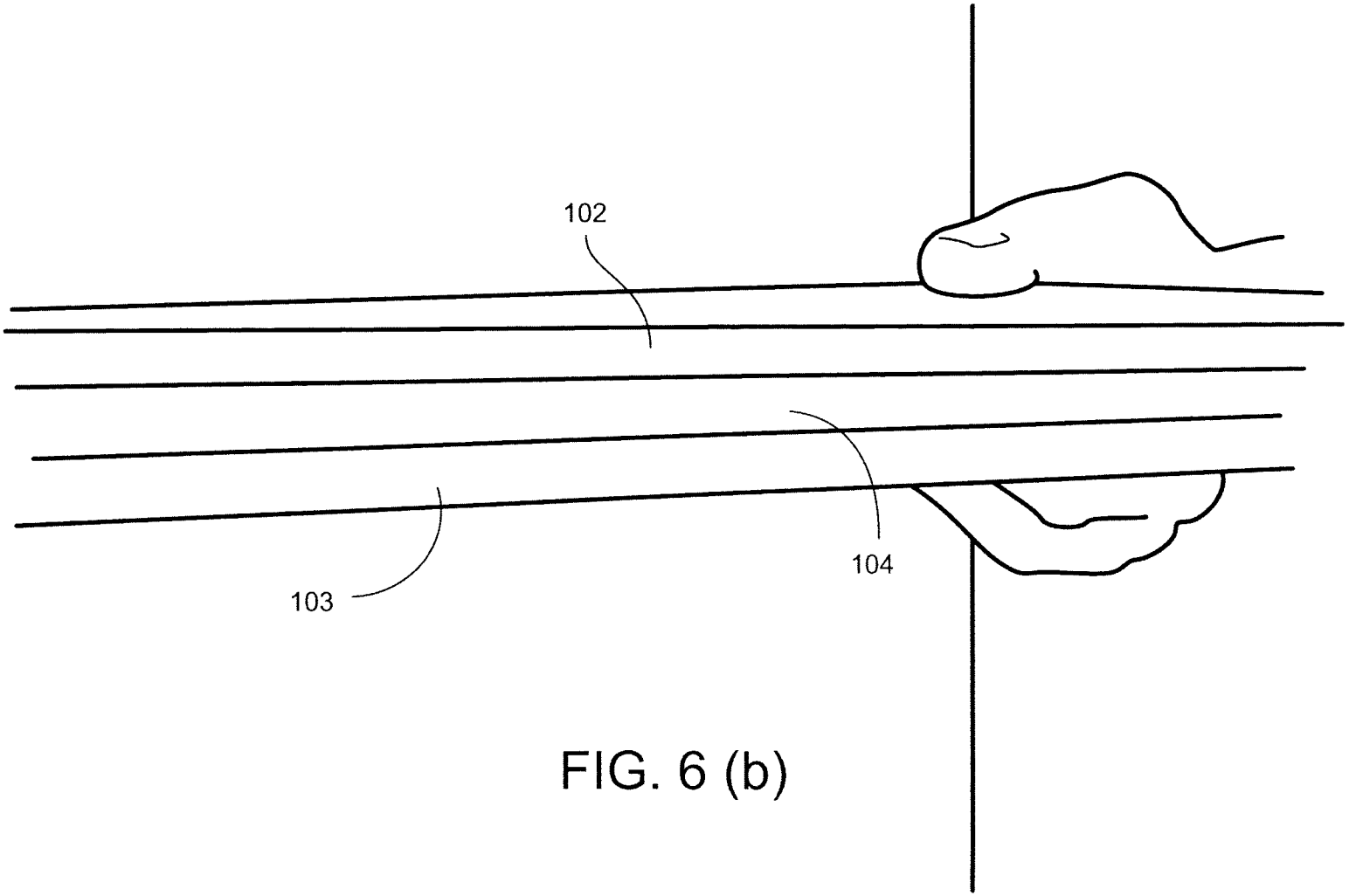
Figure 7:
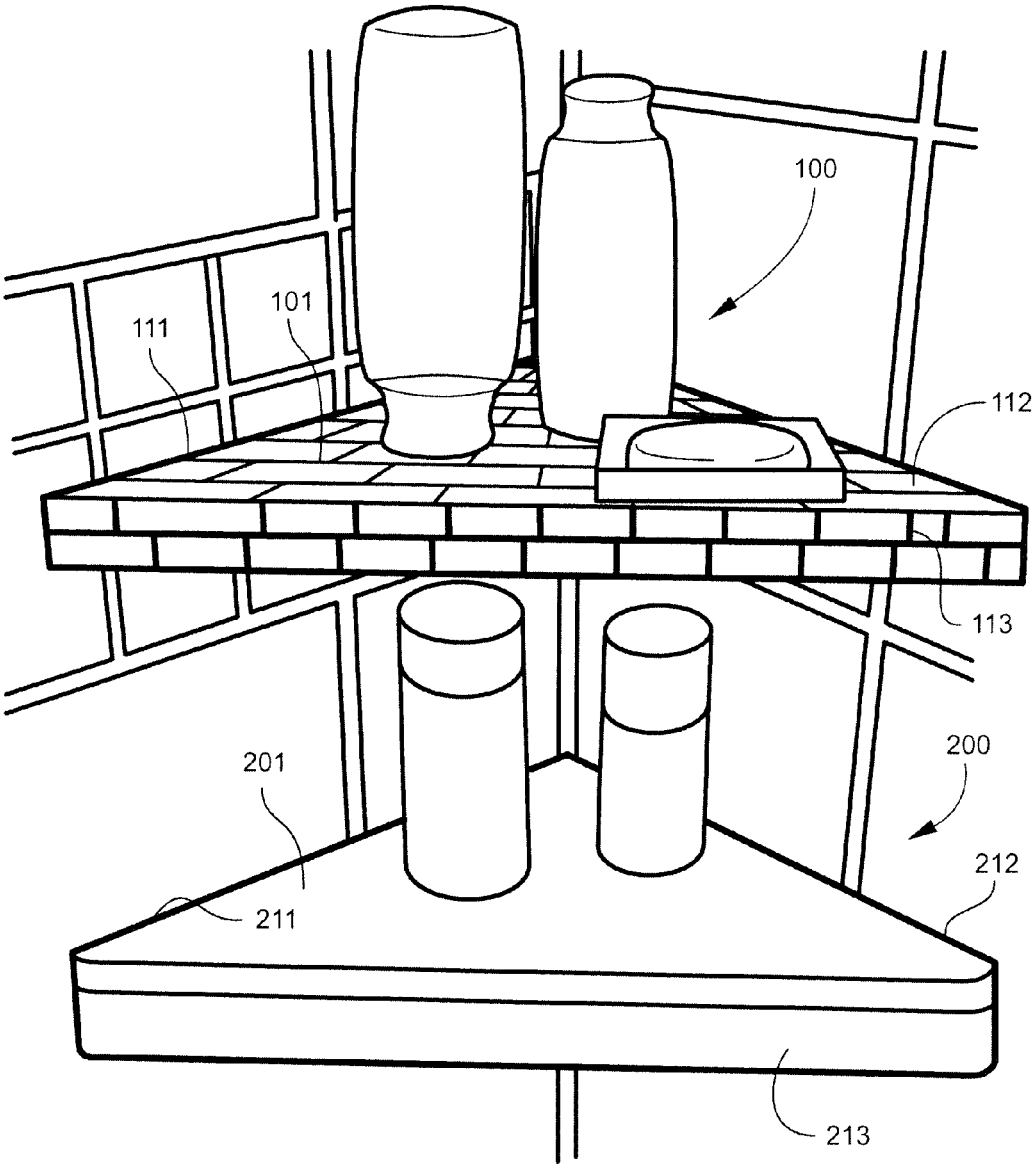
FIG. 7 depicts multiple shower corner shelves positioned within a shower corner, post-installation.

As depicted in FIGS. 4-6(*b*), corner shelf 100 includes an upper layer 101, a middle layer 102 attached to the upper layer, and a lower layer 103. In certain aspects, another middle layer 103 may be included within the shelf to increase overall thickness of shelf 100. In certain aspects, the layers may be fixed to one another with fasteners or adhesives to form shelf 100, and in certain aspects, the layers may be laminated to one another to form shelf 100. The middle layer 102 (and 104 if present) preferably includes a sturdy but lightweight material. For example, this lightweight material may include, but is not limited to, cork, wood (e.g., plywood, particle board, and/or other wood composites), water-resistant backer board, foam including, for example, Styrofoam and/or poly-urethane foam, cardboard, plastic, sheet rock, or combinations thereof. This lightweight material advantageously results in reduced manufacturing costs while simultaneously allowing for easy handling and maneuverability during installation. This lightweight material also advantageously provides adequate strength to support toiletries post-installation. In certain aspects, middle layer 102 may include a lightweight water absorbent material. Therefore, it may be important that the upper layer 101, lower layer 103, and front edge are water resistant and/or waterproof. For example, in certain aspects, the lower layer 103 may include plastic or a waterproofed material.

In certain aspects, the overall outer appearance of shelf 100 includes an upper layer 101 and front edge 113 that independently include a decorative finish that matches or compliments the shower corner in which it is being installed. For example, upper layer 101 and front edges 113 may include decorative stone such as marble or granite, tile including ceramic tile or travertine, or combinations thereof. In preferred aspects, the upper layer 101 and front edge 113 may include the same decorative finish. In alternative aspects, the upper layer 101 and front edge 113 may include different decorative finishes. Also, as indicated above, the upper layer and front edge 113 may be water resistant and/or water proof. In certain aspects, the two flat edges 111, 112 remain unfinished such that the layers 102, 103 remain readily discernible before installation. In another aspect, the two flat edges 111, 112 may be finished such that the layers 102, 103 may not be discernible. Front edge 113 preferably covers and conceals middle layer 102 (and 104 if present) and lower layer 103.

Corner shelf 100 is preferably prepackaged in a "retrofit" shower corner shelf assembly kit including (i) shelf 100 adapted for retrofitting into an existing shower corner, (ii) an adhesive composition for securing the shelf into the existing shower corner, and (iii) optionally includes a decorative composition (e.g., grout or mortar) for concealing edges of the shelf directly adjacent to the existing shower corner.

The adhesive composition may include for example a water-proof and/or moisture curable epoxy such as a caulk or sealant that can adhere corner shelf 100 to an existing shower corner. For example, silicone based epoxy that includes moisture curable siloxanes that cure within 10 minutes to 2 hours post-application, more preferably 10 minutes to 1 hour post-application, most preferably 10 minutes to 30 minutes post application. The adhesive composition is preferably pre-packaged in an individual tube.

In certain aspects, the kit also includes a prepackaged decorative composition that includes, for example, decorative grout or mortar that is identical or that strongly resembles the existing shower corner's grout or mortar.

The corner shelf 100 may be installed by applying the adhesive composition to the two flat edges 111, 112, which includes, for example, middle layer 102 (104 if present) and lower layer 103. Next, the two flat edges 111, 112 are pressed against a shower corner with sufficient force for a sufficient time period such that the adhesive composition permanently fixes the two flat edges on top of a surface of the shower corner. In certain aspects, lower layer 103, for example bottom surface 120 of the corner shelf 100, also includes two to three arcuate grooves 121 positioned on each of the opposite sides of the corner shelf for receiving mounting pins. For example, in certain aspects, mounting pins may be placed into the shower corner and portions of the lower layer 103 (e.g., arcuate grooves) may be rested on these mounting pins to provide additional support for the corner shelf 100 during installation and post-installation. As shown in FIG. 2*b*, the kit may further include decorative plugs 122 adapted for placing in the grooves 121 and concealing the groove and fastener therein, resulting in a more aesthetically pleasing appearance when viewed from the bottom after installation. The decorative plugs 122 may be adapted for a friction fit, snap fit, or press fit engagement of the grooves 121.

After adhering the flat edges 111, 112 to the shower corner, small gaps may exist between the shower corner and the flat edges 111, 112 of the shelf. To maximize aesthetics of the shelf 100 while preempting premature weakening of the adhesive bond between the shower corner and the flat edges 111, 112, the decorative composition (e.g., the decorative grout or mortar as described above) is applied such that the decorative composition preferably completely conceals the two flat edges of the shelf and the surface of the shower corner when installed shelf 100 is viewed from above, from the side, head on, below, or any combination thereof.

Figure 8:
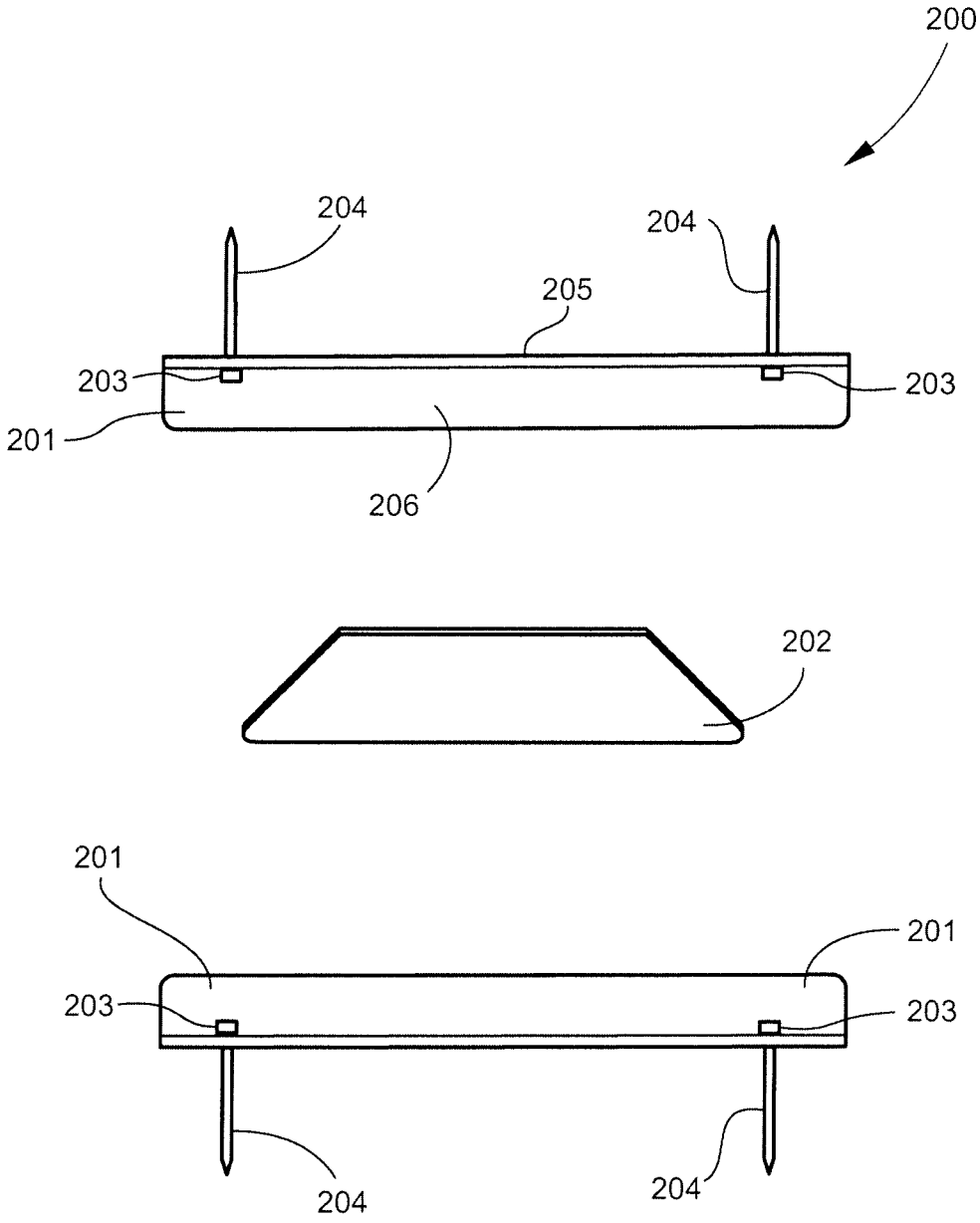
FIG. 8 depicts individual components of the shower corner shelf mounting bracket assembly.

In certain aspects, FIG. 8 depicts individual components of the shower corner shelf mounting brace assembly 200 adapted for placing the shelf thereon. The mounting bracket assembly 200 includes two or more elongate L-shaped brackets 201 each having spaced apart through holes 203 with fasteners 204 extending there through and being adapted for wall mounting (e.g., mounting to the shower corner). The L-shaped brackets 201 include a first portion 205 configured to extend in a parallel direction relative to the vertical surface of a wall when mounted to the wall, and a second portion 206 that extends in a horizontal direction being perpendicular relative to the vertical surface of the wall. The mounting bracket assembly 200 may further include a cross-brace 202 adapted for positioning on a top surface of one or more L-shaped bracket's second portion 206. In certain aspects, this cross-brace may be permanently fixed to or removably attached to each L-shaped bracket. The horizontal portions (e.g., the second portions 206) of the L-shaped brackets 201 and the cross-brace 202 cooperatively support the 220 bottom of the shelf, which does not include grooves 121, in a horizontal orientation relative to the vertical surface of the wall.

In certain aspects, the cross-brace 202 has sufficient thickness, preferably ranging between 1/16" to 1/8", to provide a slightly declined slope to the shelf once the shelf is positioned on the assembled mounting bracket assembly 200. This slightly declined slope advantageously ensures that water properly flows away from the shower corner towards the third flat, free edge 113, thereby potentially preventing premature deterioration of the two edges 111, 112 immediately adjacent the shower wall and the grout or mortar concealing these edges. The mounting bracket assembly 200 may be made from metal (e.g., aluminum, stainless steel, or a combination thereof), a molded thermoplastic resin (e.g., polyethylene, polypropylene, etc.), or a combination thereof, and the mounting bracket assembly may include and exterior finish matching the shelf. In certain aspects, the mounting bracket assembly 200 is made from a thermoplastic resin and is a single unitary component adapted for wall mounting and to support the shelves disclosed herein.

Figure 9:
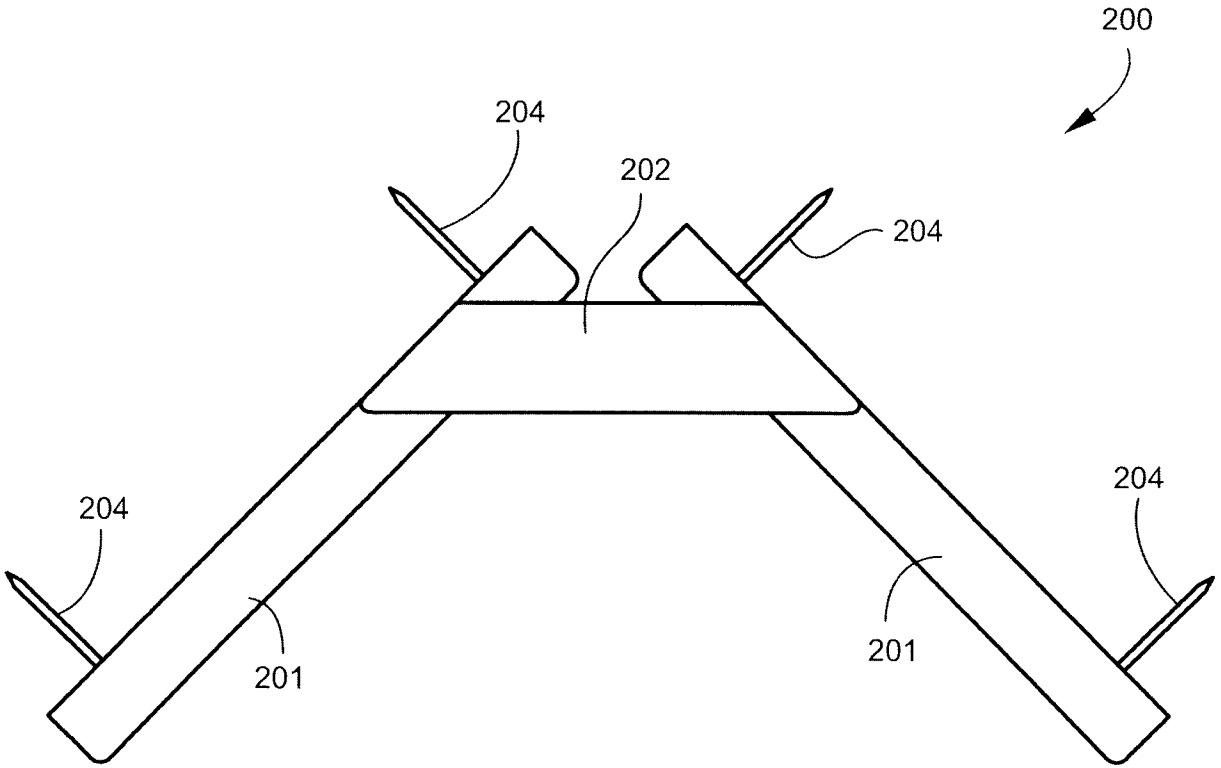
FIGS. 9(*a*), 9(*b*), and 9(*c*) respectively depict a top view, a front perspective view, and a back perspective view of the assembled corner shelf mounting brace without the shower corner shelf being positioned thereon.
Figure 9:
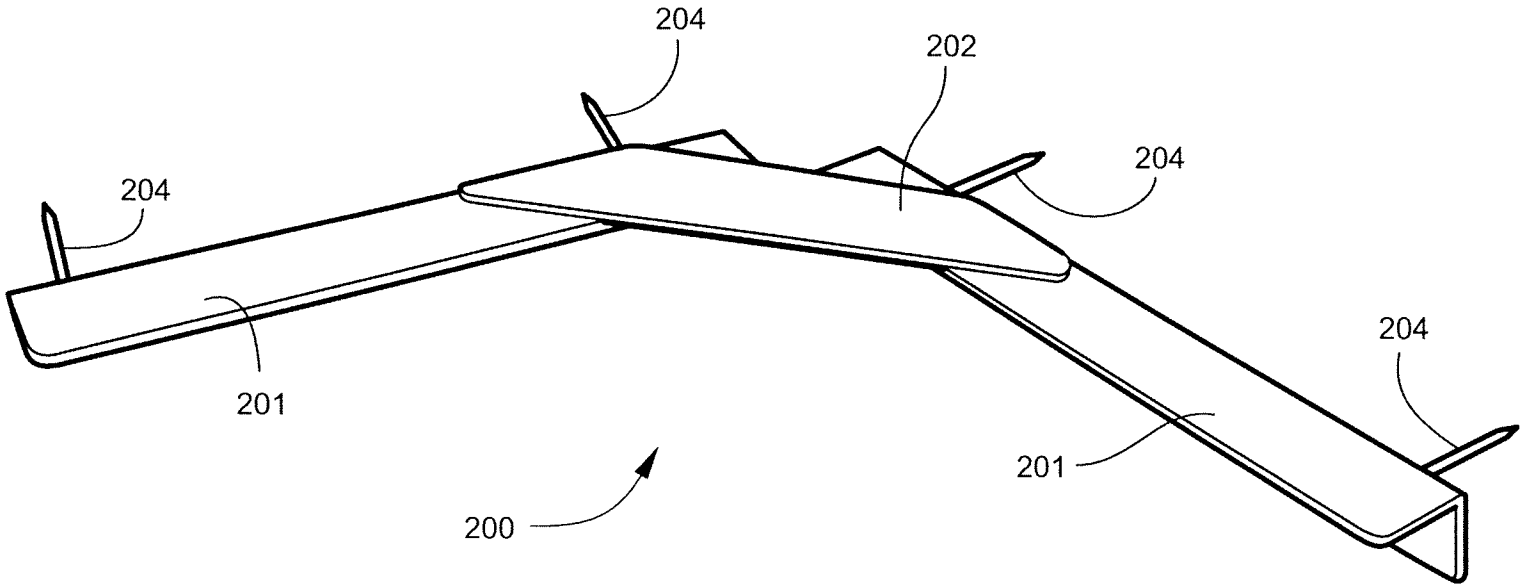
Figure 9:
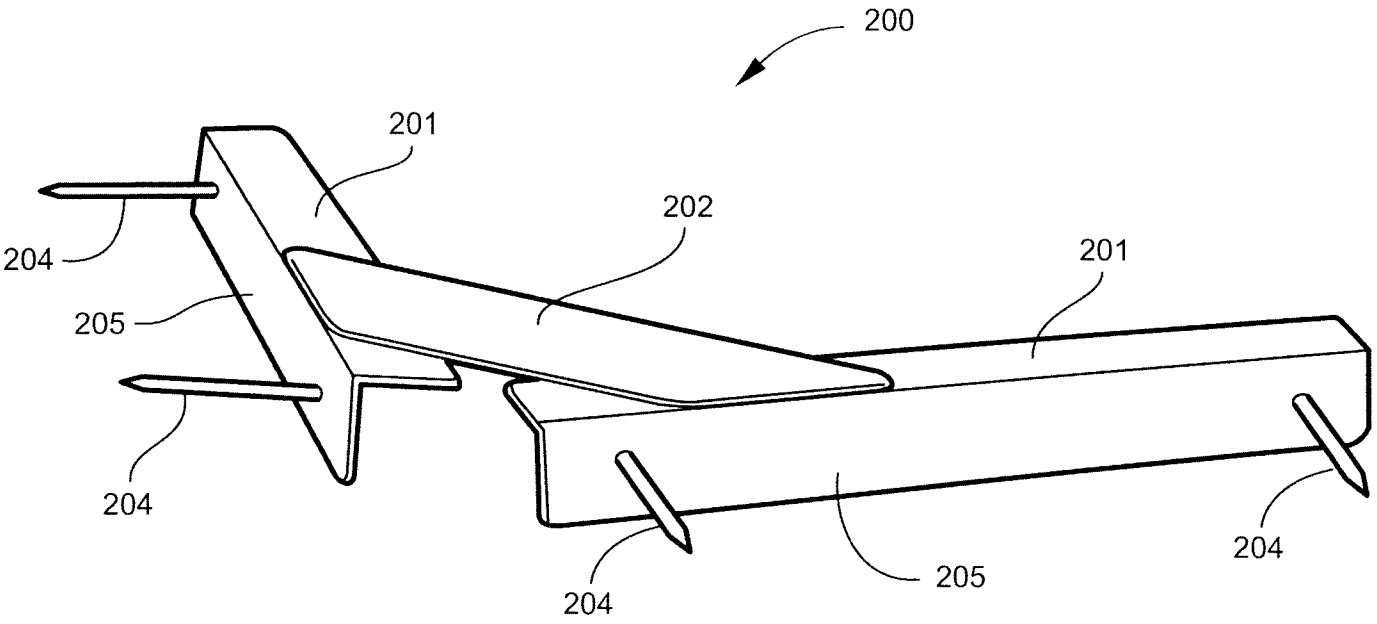

FIGS. 9(*a*), 9(*b*), and 9(*c*) respectively depict a top view, a front perspective view, and a back perspective view of the assembled shower corner shelf mounting brace assembly without the shower corner shelf being positioned thereon.

Figure 10:
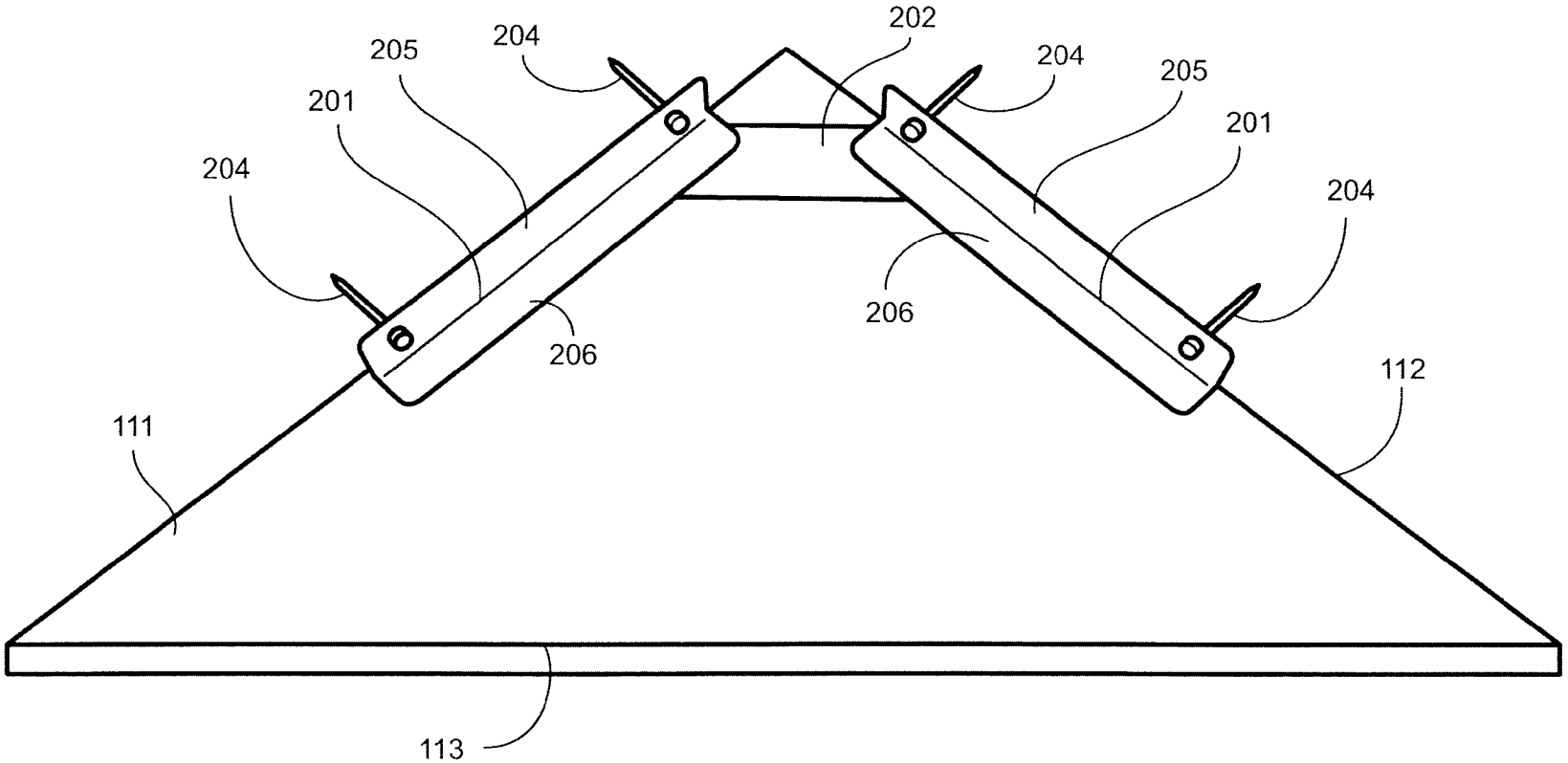
FIG. 10 depicts a bottom view of the assembled corner shelf mounting brace with the shower corner shelf being positioned thereon.

FIG. 10 depicts a bottom view of the assembled corner shelf mounting brace assembly 200 with the shower corner shelf being positioned thereon and being cooperatively supported by each L-shaped bracket's second portion 206 and cross-brace 202 in a horizontal orientation relative to the vertical surface of the wall.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. A retrofit shower corner shelf assembly comprising:

a shelf configured for retrofitting into a shower corner having a predetermined shape with a first peripheral edge and a second peripheral edge that are each configured to be laterally adjacent to and contact opposite sides of the shower corner and a third peripheral edge that remains free post-installation;

an adhesive composition for securing the first and second peripheral edges to opposite sides of the shower corner; and a decorative composition for concealing the first and second edges of the shelf directly adjacent to the shower corner post-installation, wherein:

the shelf is attached to a mounting bracket assembly configured to fasten the shelf to the shower corner at a declined angle in a direction extending toward the third peripheral edge that remains free post-installation in order to allow water to flow away from the shelf;

wherein the mounting bracket assembly comprises a first L-shaped bracket and a second L-shaped bracket configured to attach to opposite sides of a shower corner and a planar trapezoidal shaped cross-brace;

wherein the first and second L-shaped brackets each respectively have a first portion configured to extend in a parallel direction relative to a vertically extending surface of the shower corner and a second flange portion configured to extend perpendicularly relative to the vertically extending surface of the shower corner, wherein the cross-brace is secured to and connects the second flange portion of the first L-shaped bracket to the second flange portion of the second L-shaped bracket and contacts the bottom surface of the shelf thereby cooperatively supporting the shelf;

wherein each L-shaped bracket has through holes positioned at opposite ends of the first portion of the L-shaped bracket with fasteners extending through each through hole that are configured to attach each L-shaped bracket to the shower corner.

2. The retrofit shower corner shelf assembly of claim 1, wherein the first L-shaped bracket, second L-shaped bracket, and cross-brace each comprise a metal or metal alloy, a thermoplastic, or a combination thereof.

3. The retrofit shower corner shelf assembly of claim 2, wherein the first L-shaped bracket, second L-shaped bracket, and cross-brace each comprise a same material and each having a decorative exterior matching the shelf.

4. The retrofit shower corner shelf assembly of claim 3, wherein the first L-shaped bracket, second L-shaped bracket, and cross-brace are aluminum or stainless steel.

5. The retrofit shower corner shelf assembly of claim 3, wherein the first L-shaped bracket, second L-shaped bracket, and cross-brace are formed of the thermoplastic, and the mounting bracket assembly is a single, continuously formed component.

6. The retrofit shower corner shelf assembly of claim 1, wherein the shelf comprises an upper layer, a middle layer, and a lower layer.

7. The retrofit shower corner assembly of claim 3, wherein the upper layer of the shelf comprises decorative stone, tile, or combinations thereof.

8. The retrofit shower corner assembly of claim 7, wherein the middle layer comprises a lightweight material.

9. The retrofit shower corner assembly of claim 8, wherein the lightweight material comprises cork, wood, cardboard, plastic, or combinations thereof.

10. The retrofit shower corner assembly of claim 9, wherein the third peripheral edge of the shelf is a front edge having decorative material that completely covers and conceals the middle and lower layers of the shelf.

11. The retrofit shower corner assembly of claim 10, wherein the front edge comprises the same decorative material as the upper layer.

12. The retrofit shower corner assembly of claim 11, wherein the lower layer comprises the same decorative material as the upper layer.

13. The retrofit shower corner assembly of claim 1, further comprising two or more shelves.

14. The retrofit shower corner assembly of claim 3, further comprising packaging containing the shelf, adhesive, and decorative composition.

15. The retrofit shower corner assembly of claim 6, wherein the predetermined shape is triangular.

* * * * *